US006220063B1

(12) United States Patent
Wunderlich et al.

(10) Patent No.: US 6,220,063 B1
(45) Date of Patent: Apr. 24, 2001

(54) DRIVE SYSTEM FOR CLOTHES WASHER

(75) Inventors: Daniel F. Wunderlich; John F. Broker; Keith E. Kropf; John E. Thomas, all of Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/247,740

(22) Filed: Feb. 9, 1999

(51) Int. Cl.[7] ..... D06F 23/04
(52) U.S. Cl. ..... 68/133; 68/134; 68/23.7
(58) Field of Search ..... 68/23 R, 23.7, 68/134, 131, 133

(56) References Cited

U.S. PATENT DOCUMENTS

| | | | | |
|---|---|---|---|---|
| 482,684 | | 9/1892 | Herder . | |
| 1,553,690 | | 9/1925 | Hogan . | |
| 1,613,391 | | 1/1927 | Greene . | |
| 1,814,031 | | 7/1931 | Gleaves . | |
| 1,839,857 | | 1/1932 | Apple . | |
| 2,034,244 | * | 3/1936 | Mikulasek | 68/131 |
| 2,145,453 | | 1/1939 | Miller . | |
| 2,344,253 | | 3/1944 | Kirby . | |
| 2,381,545 | | 8/1945 | Kirby . | |
| 2,408,509 | | 10/1946 | Clark . | |
| 2,499,025 | | 2/1950 | Horvath . | |
| 2,516,656 | * | 7/1950 | Smith | 68/131 |
| 2,520,685 | | 8/1950 | Horvath . | |
| 2,542,528 | | 2/1951 | Horvath . | |
| 2,645,107 | | 7/1953 | Smith . | |
| 2,645,917 | | 7/1953 | Kirby . | |
| 2,906,111 | | 9/1959 | Long et al. . | |
| 3,155,462 | | 11/1964 | Erickson et al. . | |
| 3,318,119 | | 5/1967 | Barks . | |
| 3,491,387 | | 1/1970 | Candor et al. . | |
| 3,635,055 | * | 1/1972 | Smith | 68/131 |
| 4,114,406 | | 9/1978 | Horowitz et al. . | |
| 4,483,161 | | 11/1984 | Oida . | |
| 4,631,934 | | 12/1986 | Imanishi et al. . | |
| 5,794,633 | * | 8/1998 | Song | 68/133 |
| 5,829,277 | | 11/1998 | Wunderlich | 68/23.6 |
| 5,850,750 | * | 12/1998 | Cho | 68/134 |
| 5,950,460 | * | 9/1999 | Oh | 68/134 |

FOREIGN PATENT DOCUMENTS

| | | | | |
|---|---|---|---|---|
| 526691 | * | 3/1954 | (BE) | 68/133 |
| 304010 | * | 3/1955 | (DE) | 68/133 |
| 1010046 | * | 6/1957 | (DE) | 68/133 |
| 1125004 | * | 7/1956 | (FR) | 68/133 |
| 1131586 | * | 10/1956 | (FR) | 68/133 |
| 1278510 | * | 10/1961 | (FR) . | |
| 694288 | * | 7/1973 | (GB) | 68/133 |
| 306974 | * | 7/1955 | (IT) | 68/133 |
| 54-158072 | * | 12/1979 | (JP) | 68/131 |
| 59-186592 | | 10/1984 | (JP) . | |

* cited by examiner

*Primary Examiner*—Frankie L. Stinson
(74) *Attorney, Agent, or Firm*—Zarley, McKee, Thomte, Voorhees & Sease

(57) ABSTRACT

A washing machine includes a cabinet with an opening. A wash basket is mounted within the cabinet for rotation about a wash basket axis, and includes an access opening through which clothes may be loaded and unloaded. At least one agitator is mounted within the basket for rotation about an agitator axis which is at an angle different from the angle of the wash basket axis. A drive mechanism bathed by washing fluid interconnects a drive motor, the wash basket, and the agitator for rotating the agitator about its rotational axis.

19 Claims, 5 Drawing Sheets

DRIVE SYSTEM FOR CLOTHES WASHER

BACKGROUND OF THE INVENTION

Conventional clothes washing machines are of two basic types: a vertical axis, top loading machine and a horizontal axis front loading machine. While front loading machines are generally more economical with respect to water consumption and electrical usage, the top loading machines typically provide easier access. Both types of washing machines include a perforated basket which holds the clothes or articles being washed. In the front loading machine, the clothes are tumbled in the wash water while the basket rotates. In a top loading machines, an oscillating or rotating agitator mixes the clothes and articles in the wash water while the basket remains substantially stationary. At the completion of the wash cycle in either machine, the basket is rotated at a high RPM to extract the wash water from the basket and the clothes therein.

An objective of the present invention is the provision of an improved top loading washing machine.

A further objective is to provide a top loading washer having rotatable agitators/lifters within a washing basket.

A further objective is to provide a novel drive system for rotating the agitators/lifters within a washing basket.

A further objective is to provide a drive system for agitators within a washing basket wherein the drive system is at least partially bathed in washing fluid.

Another objective of the present invention is the provision of a top loading washing machine having low water usage, yet excellent mechanical washing action.

Another objective of the present invention is the provision of a top loading washing machine having a simple and durable construction.

A further objective of the present invention is the provision of an improved top loading, washing machine which is economical to manufacture and to operate.

SUMMARY OF THE INVENTION

The foregoing objects may be achieved by a washing machine having a cabinet with a top opening. A wash basket is mounted within the cabinet for rotation about a wash basket axis. The wash basket has an upwardly facing access opening through which clothes may be loaded and unloaded. At least a first agitator/lifter is mounted in the basket for rotation about an agitator axis which is at an angle different from the angle of the wash basket axis. A drive motor is mounted to the cabinet. A drive mechanism interconnects the motor, the wash basket, and the first agitator for rotating the first agitator about the first agitator axis when the wash basket is held against rotation about its wash basket axis.

It is preferred that a second agitator also be mounted within the wash basket and that it also be driven by the drive mechanism.

A tub at least partially surrounds the wash basket and contains washing fluid. The drive mechanism preferably is at least partially submerged in and bathed by the washing fluid.

While the shape of the washing basket and tub may vary without detracting from the invention, it is preferable that the washing basket and the tub be spherical, and that the agitators each have a concave surface and a convex surface, with the convex surfaces nesting against the spherical walls of the washing basket.

DETAILED DESCRIPTION OF THE PREFERRED EMBODIMENT

Figure 1:
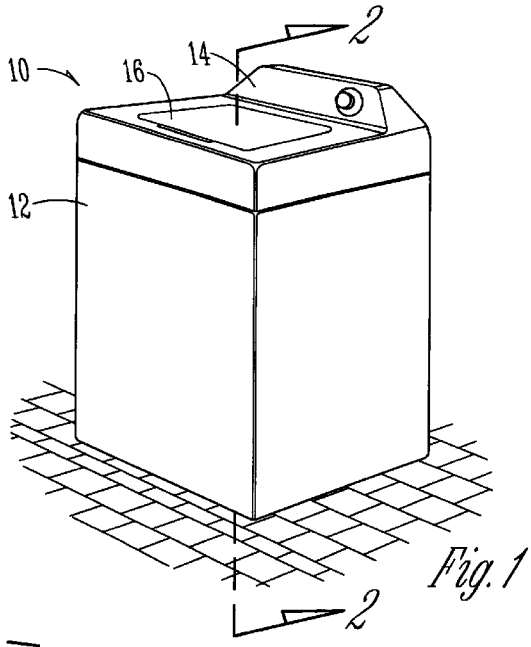
FIG. 1 is a perspective view of the washing machine of the present invention.

Referring to the drawings the numeral 10 generally designates the washing machine of the present invention. Washing machine 10 includes a cabinet 12, a control panel 14, an access opening 15 (FIG. 2), and a door 16 which is hinged to move from an open to a closed position over the access opening 15.

Mounted within the lower end of the cabinet 12 on a web 23 is a reversible drive motor 18 of conventional construction. Motor 18 has an output shaft 20 which extends upwardly through a bearing 22 in the web 23. In this embodiment, motor 18 is attached to the web 23 by brackets 24. Shaft 20 extends upwardly through a clutch 26 shown schematically in FIGS. 2 and 4. Clutch 26 is adapted to respond to rotation of the shaft 20 in a first direction to drive a hub 34 which is connected to a spherically shaped basket 40. Rotation of the shaft 20 in the opposite direction disengages the clutch 26 and permits the shaft 20 to rotate independently of hub 34.

Figure 2:
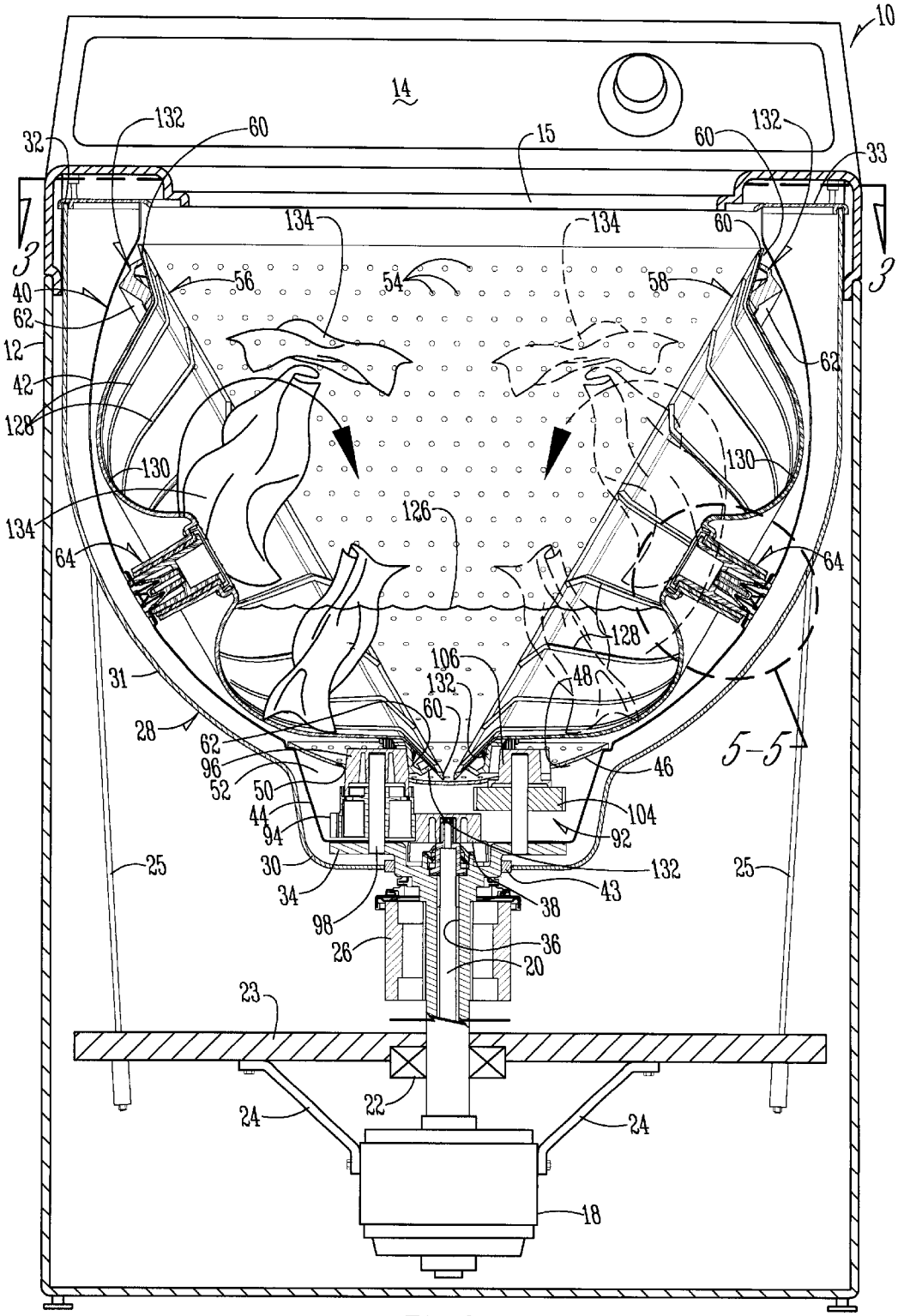
FIG. 2 is a sectional view taken generally along line 2—2 of FIG. 1.
Figure 4:
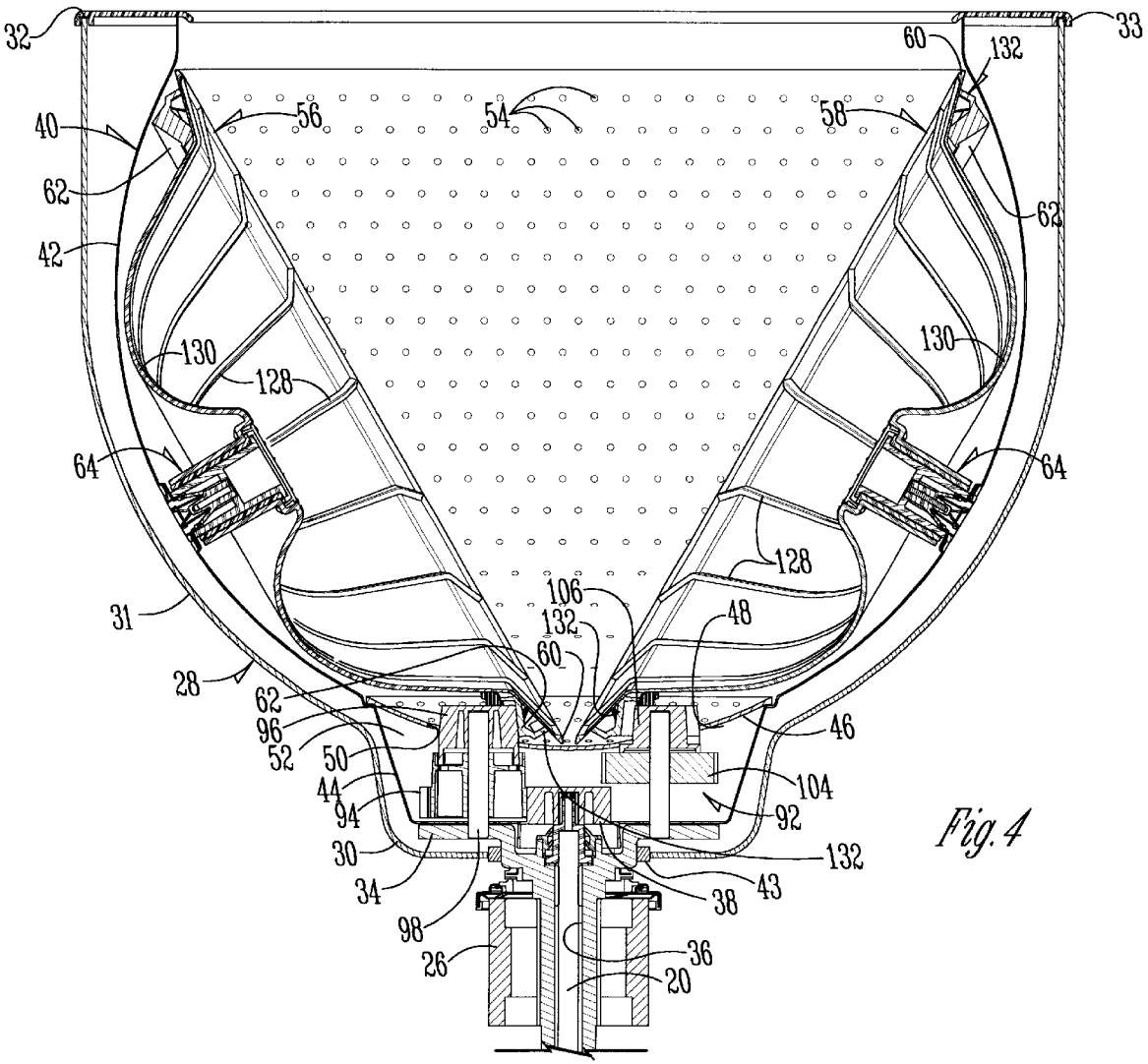
FIG. 4 is an enlarged detailed view of the gear drive mechanism for the present invention.

As best shown in FIGS. 2 and 4, a tub 28 includes at its lower end a basin 30 for holding washing fluid. Extending upwardly from basin 30 is a spherically shaped lower tub portion 31. The tub 28 extends upwardly to the top of basket 40 and terminates at an upper edge 32. A tub cover 33 is attached to the upper edge 32 and extends inwardly over a portion of the top opening 41 of basket 40. The tub cover 33 is cooperable with access opening 15 for providing a path into basket 40.

Hub 34 includes a central bore 36 which receives output shaft 20. Output shaft 20 is attached at its upper end to a drive gear 38.

Hub 34 extends through the basin 30 by way of a rotary seal arrangement shown schemactially at 43 in FIGS. 2 and 4 and is attached to the basket 40 which includes a spherical portion 42 and a gear box portion 44 in its lower end. Extending over the top of the gear box portion 44 is a curved wall 46 which forms an extension of the spherically shaped walls of spherical portion 42. Curved wall 46 includes a first gear hole 48 and a second gear hole 50 therein. The space below the curved wall 46 comprises a gear box chamber 52 for housing the gear drive to be described hereafter.

Basket 40 includes a plurality of perforations in its spherical shaped walls 42 for permitting fluid communication between the interior of basket 40 and the tub 28. Thus, as fluid is introduced into the basket 40, the fluid flows through apertures 54 and enters the tub 28 also. As further depicted in FIG. 2, the web 23, drive motor 18 and the washing assembly are shown suspended from the inside of cabinet 10 by a conventional hung strut suspension system 25 which is of known construction and does not comprise part of the instant invention.

Agitator/lifter pans 56, 58 each include a circular peripheral rim 60 and a circular pan gear 62 which extends circumferentially around the back side of the rim 60.

Figure 5:
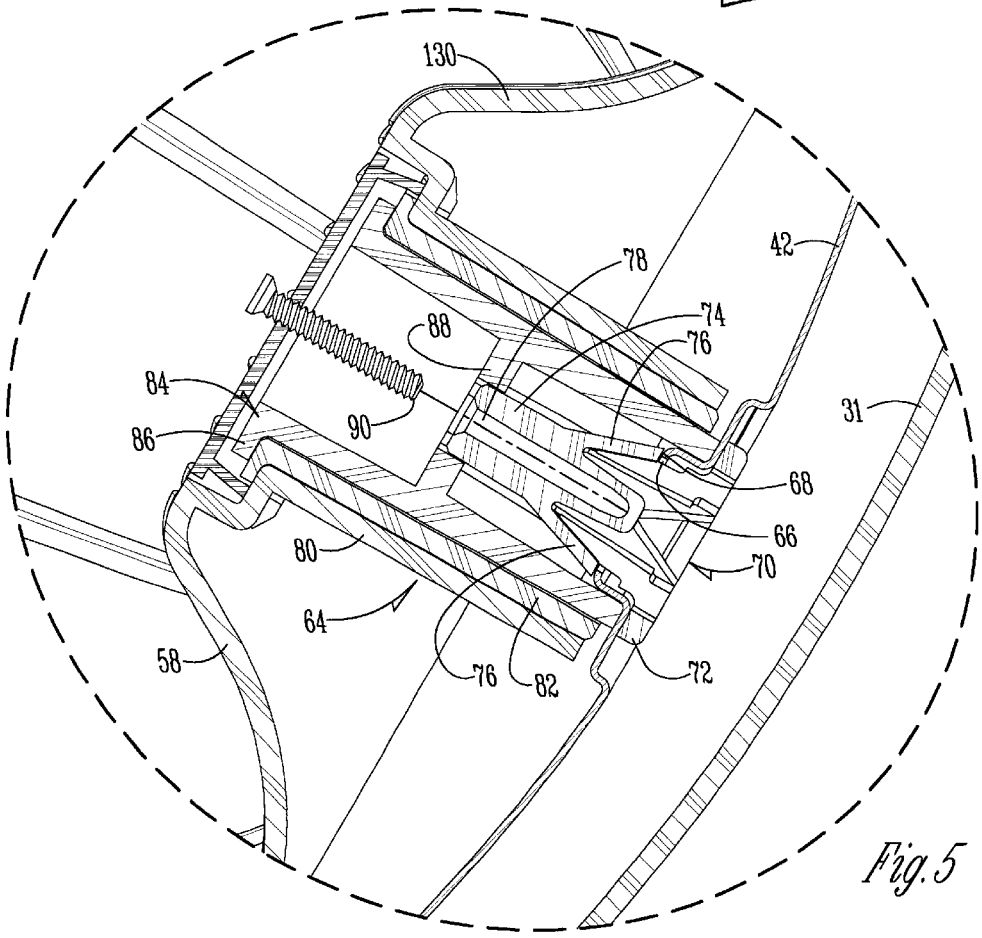
FIG. 5 is an enlarged detailed view taken generally along line 5—5 of FIG. 2.

Agitator/lifter pans 56, 58 are each rotatably mounted to the basket 40 by a pan mount assembly 64 which is shown in enlarged detail in FIG. 5. The spherical portion 42 of basket 40 includes an opening 66 in each of the opposite sides thereof. Opening 66 is surrounded by an annular shoulder 68. A plug body 70 includes a head 72 and a shank 74. Spring fingers 76 extend radially outwardly from the shank 74 and are adapted to move yieldably inwardly. The plug 70 is inserted through the opening 66 in the basket wall 42. During insertion spring fingers 76 cam radially inwardly and slip past the annular shoulders 68 surrounding opening 66. After the spring fingers clear the annular shoulder 68 they spring outwardly and retain the plug 70 within the opening 66. Shank 74 of plug body 70 includes a screw receptacle 78.

Agitator/lifter pans 56 and 58 are each provided with a cylindrical outer sleeve 80 in which is inserted a bearing boss 82. Inserted within boss 82 is a locking tube 84 having a head 86 and a web 88. A screw 90 extends through web 88 and is threaded into the screw receptacle 78 of plug 70. This attaches the agitator pans 56, 58 to the side walls 42 of basket 40, while at the same time permitting the agitator pans 56, 58 to rotate about the cylindrical axes of the sleeves 80.

Figure 6:
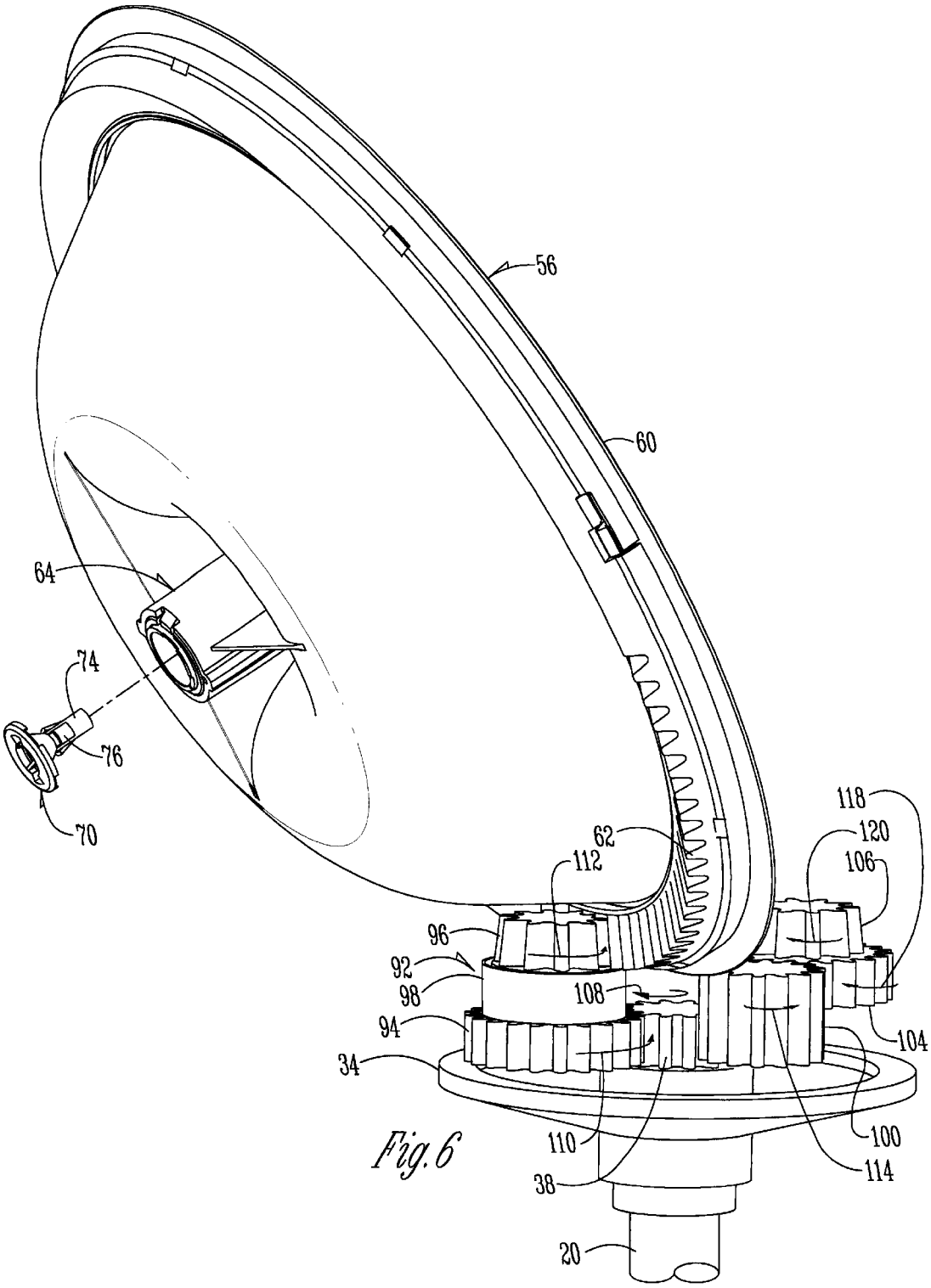
FIG. 6 is a pictorial view showing the gear drive assembly and one agitator pan.

Referring to FIGS. 4 and 6, a gear assembly 92 is housed within the gear box chamber 52 and includes a first driven gear 94 which directly engages the annular teeth of the drive gear 38. First driven gear 94 is connected to a first pan gear 96 by a gear shaft 98. An idler gear 100 is also directly driven by drive gear 38. Idler gear 100, in turn, engages gear 104 which has a second pan drive gear 106 on its upper surface.

In operation, shaft 20 drives gear 38 in a clockwise direction indicated by arrow 108 (FIG. 6). This rotates gears 94, 100 in the directions shown by arrows 110, 114 respectively. Rotation of gear 94 causes similar rotation of first pan gear 96 in the direction indicated by arrow 112. First pan gear 96 engages the teeth of the circumferential gear 62 on the back of peripheral rim 60 on agitator pan 56. This causes rotation of agitator pan 56 about its axis formed by the pan mount assembly 64.

Rotation of idler gear 100 causes rotation of gear 104 in the direction indicated by arrow 118. This also causes rotation of second pan gear 106 in the direction indicated by arrow 120. In this embodiment, the rotational axis of agitator pans 56 and 58 are each located 60 degrees from the vertical rotational axis of the drive gear 38 and opposite one another. Because of this angular disposition, the rotational planes of the circumferential gears 62 and the first and second pan gears 96, 106 operate at an acute angle with respect to each other.

Figure 3:
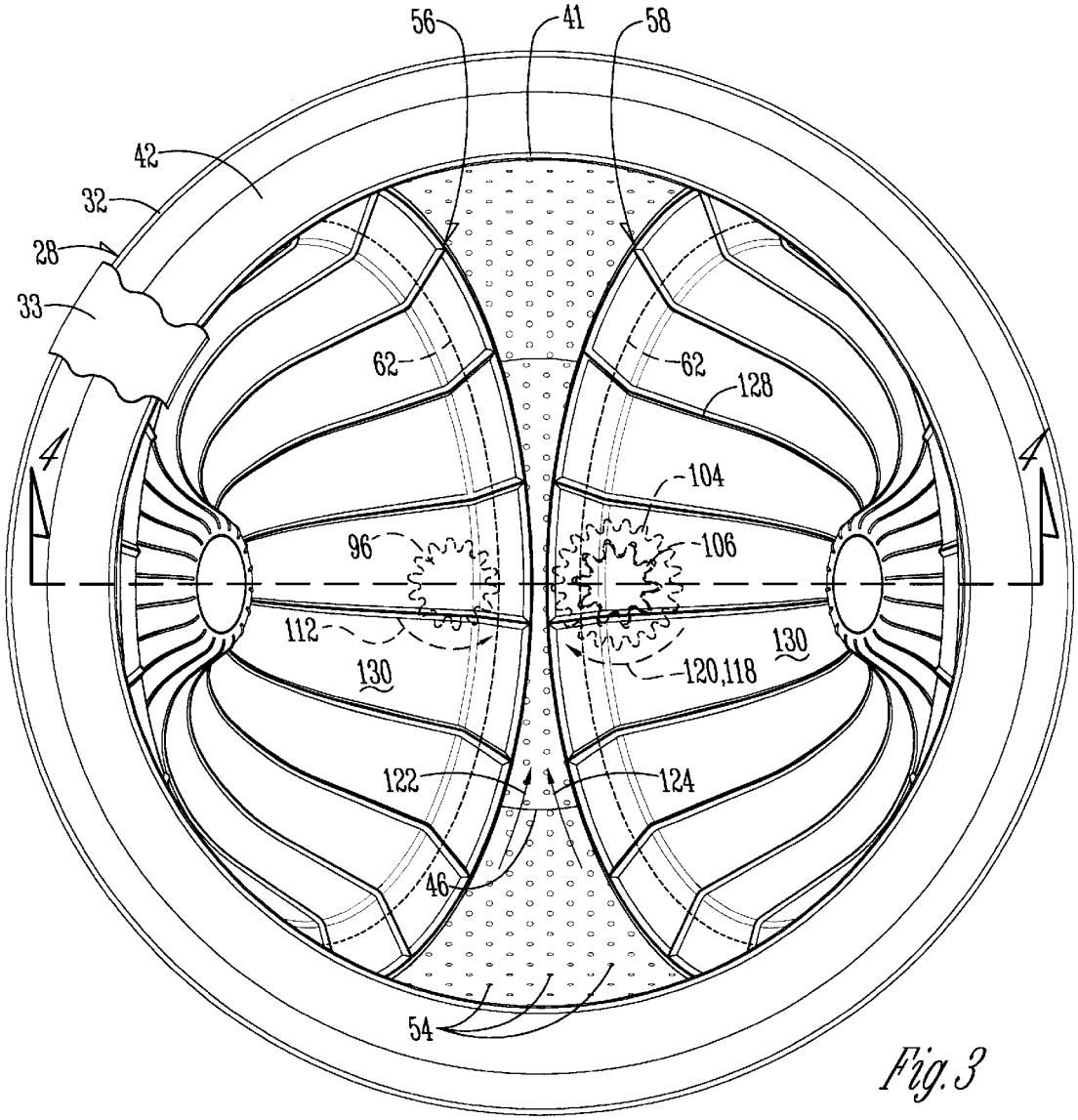
FIG. 3 is a sectional view taken generally along line 3—3 of FIG. 2.

It should be noted that first and second pan gears 96, 106, rotate in opposite directions, thereby causing the agitator pans 56, 58 to also rotate in opposite directions as indicated by the arrows 122, 124 in FIG. 3. Alternately, gearing can be provided to cause agitator pans 56, 58 to rotate in the same direction if desired.

All the gears in gear assembly 92 are preferably formed of a plastic material so that they can be bathed within the washing fluid within basin 30 of tub 28 and within the gear box chamber 52 of basket 40. Various types of noncorrosive materials may be used, but the preferred material is a thermoplastic polymer sold under the trademark Carilon by Shell Chemical Company.

As can be seen in FIG. 2 the water or washing fluid level 126 is at approximately the level of the pan mount assemblies 64. The rotation of the two agitator pans 56, 58 creates a tumbling action of the fabrics 134 being washed within the washing basket 40. This tumbling action is facilitated by ribs 128 which are formed on the interior concave surfaces 130 of the agitator pans 56, 58. The back surfaces of agitator pans 56, 58 are convex. While they do not conform precisely to the interior spherical surface of the basket 40 they are shaped to nest against this interior surface with the annular rims 60 of the pans 56, 58 bearing against the curved spherical wall 42 of basket 40. The annular rim 60 is provided with a seal 132 which prevents the fabrics or clothing from becoming entangled with the first and second pan gears 96, 106 which protrude upwardly through the first and second gear holes 48, 50 in the curved wall portion 46, and which engage the circumferential gears 62 on the back sides of rims 60 of the agitator pans 56, 58.

The present invention has been found to provide superior washing capabilities over prior art washing machines. The tumbling action provided by agitator pans 56, 58 is a gentle action that minimizes damage and wear to delicate fabrics. Furthermore, the ribs 128 on the interiors of agitator pans 56, 58 cause a lifting of the washing fluid and improve the cleaning of the fabrics within the basket 40.

The gear assembly 92 for driving the pans 56, 58 is submerged within the washing fluid, and is bathed by the washing fluid throughout the operation of the device.

After the washing cycle has been completed, motor 18 is reversed, and the reverse rotation of shaft 20 causes the clutch 26 to engage with the hub 34, thereby causing the basket 40 to rotate for its spin cycle. During the spin cycle the washing fluid passes outwardly through apertures 54 due to centrifugal force. The fluid within tub 28 is drained away.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A washing machine comprising:

a cabinet;

a wash basket mounted within said cabinet for rotation about a wash basket axis, said wash basket having an access opening through which clothes may be loaded and unloaded;

at least a first agitator mounted in said wash basket for rotation about a first agitator axis which is at an angle different from the angle of said wash basket axis, the first agitator having a front surface adapted to tumble laundry and an opposite rear surface unexposed to the laundry, the first agitator having a peripheral edge with gear teeth extending along the peripheral edge on the rear surface of the agitator;

a drive motor;

a drive mechanism interconnecting said motor, said wash basket, and said gear teeth of the first agitator for rotating said first agitator about said first agitator axis when said wash basket is held against rotation about said wash basket axis.

2. A washing machine according to claim 1 and further comprising a second agitator mounted in said wash basket for rotation about a second agitator axis which is at an angle different from both said first agitator axis and said wash basket axis, the second agitator having a front surface adapted to tumble laundry and an opposite rear surface unexposed to the laundry, the second agitator having a peripheral edge with gear teeth extending along the peripheral edge on the rear surface of the agitator, said drive mechanism also being connected to said gear teeth of the second agitator for rotating said second agitator about said second agitator axis.

3. A washing machine according to claim 2 and further comprising a tub at least partially surrounding said wash basket, said tub containing a washing fluid, said drive mechanism being at least partially submerged in and surrounded by said washing fluid.

4. A washing machine according to claim 2 wherein said drive mechanism includes a drive gear connected to and driven by said drive motor, a first gear engaging said teeth of said first agitator for rotating said first agitator, and a second gear engaging said teeth of said second agitator for rotating said second agitator, gear mechanism connecting said drive gear to said first and second gears for rotating said first and second gears.

5. A washing machine according to claim 4 wherein said gear mechanism is adapted to rotate said first and second gears in opposite directions to cause said first and second agitators to rotate in opposite directions.

6. A washing machine according to claim 2 wherein said wash basket includes a bottom portion, said peripheral edges of the first and second agitators being positioned to pass through said bottom portion of said wash basket during rotation of said first and second agitators respectively, said drive mechanism engaging said peripheral edges of said first and second agitators in said bottom portion of said wash basket for rotating said first and second agitators.

7. The washing machine of claim 1 wherein the drive mechanism is between the agitator and the wash basket.

8. The washing machine of claim 1 wherein the drive mechanism is covered so as to preclude exposure to laundry.

9. The washing machine of claim 1 wherein the drive mechanism is lubricated by wash water in the wash basket.

10. A washing machine comprising:

a cabinet with an opening;

a tub mounted within said cabinet and having a tub cavity therein;

a wash basket having a basket cavity therein and being mounted within said tub for rotation about a wash basket axis, said wash basket having an access opening through which clothes may be loaded and unloaded, said wash basket having a plurality of holes therein providing fluid communication between said wash basket cavity and said tub cavity;

first and second agitators mounted within said wash basket for rotation about first and second agitator axes respectively, said agitators each having a peripheral edge and a driven gear mounted along said edge between the agitator and the basket cavity;

said basket cavity and said tub cavity each having depressed bottom portions;

a perforated cover overlying said depressed portion of said basket cavity;

a drive motor; and a drive mechanism mounted in said depressed portion of said basket cavity below said cover and including first and second drive gears extending through said cover and engaging said driven gears of said first and second agitators to interconnect said drive motor and said first and second agitators for rotating said first and second agitators about said first and second agitator axes respectively.

11. A washing machine according to claim 10 wherein said tub is adapted to hold a reservoir of washing fluid in said bottom portion of said tub cavity, said drive mechanism being at least partially bathed within said washing fluid when said washing fluid is within said bottom portion of said tub cavity.

12. The washing machine of claim 10 wherein the first and second drive gears of the drive mechanism are behind the first and second agitators, respectively, so as to preclude exposure of laundry to the drive mechanism.

13. The washing machine of claim 10 wherein the drive mechanism is lubricated by wash water in the wash basket.

14. A washing machine comprising:

a cabinet having an opening;

a tub mounted within said cabinet and having a tub cavity for holding a reservoir of washing fluid;

a wash basket mounted within said tub and having a basket cavity therein;

first and second agitators rotatably mounted in said wash basket for rotation about first and second agitator axes, respectively;

a drive motor;

a drive mechanism connecting said drive motor to said first and second agitators for drivingly engaging the agitators and rotating said first and second agitators about said first and second agitator axes respectively;

said drive mechanism being at least partially positioned within said tub cavity and being bathed by said washing fluid within said tub cavity; and said drive mechanism being protected from exposure to laundry.

15. A washing machine according to claim 14 wherein said wash basket is substantially spherical in shape and includes spherically shaped walls.

16. A washing machine according to claim 15 wherein said first and second agitators each include a concave surface and an opposite convex surface.

17. A washing machine according to claim 16 wherein said concave surfaces of said first and second agitators face inwardly toward the interior of said wash basket cavity.

18. A washing machine according to claim 17 wherein said convex surfaces are in close proximity to said spherically shaped walls of said wash basket.

19. The washing machine of claim 14 wherein the drive mechanism is between the agitators and the wash basket.

* * * * *